United States Patent [19]

Knickerbocker

[11] Patent Number: 4,915,266

[45] Date of Patent: Apr. 10, 1990

[54] AEROSOL ASSEMBLY FOR FILLING

[75] Inventor: Michael G. Knickerbocker, McHenry, Ill.

[73] Assignee: Seaquist Valve Company, Pittway Corp., Cary, Ill.

[21] Appl. No.: 527,040

[22] Filed: Aug. 29, 1983

Related U.S. Application Data

[63] Continuation-in-part of Ser. No. 347,886, Feb. 11, 1982, abandoned.

[51] Int. Cl.[4] ..... B65B 1/04

[52] U.S. Cl. ..... 222/402.16; 141/20

[58] Field of Search ..... 222/394, 399, 400.7, 222/402.1, 402.14, 402.16:402.24, 402.25, 478, 559; 141/20, 2-3; 215/DIG. 1

[56] References Cited

U.S. PATENT DOCUMENTS 3,122,180 2/1964 Abplanalp ..... 222/402.16
4,061,240 12/1977 Brownbill ..... 215/270

FOREIGN PATENT DOCUMENTS 798684 7/1958 United Kingdom ..... 222/402.16
2060080 4/1981 United Kingdom ..... 222/402.18

*Primary Examiner*—Michael S. Huppert
*Attorney, Agent, or Firm*—Frijouf, Rust & Pyle

[57] ABSTRACT

An improved aerosol assembly is disclosed for filling an aerosol container having an aerosol valve and a mounting cup turret with a turret aperture for receiving a valve stem. The aerosol container receives an aerosol product for discharge through the valve stem upon opening of the aerosol valve. The invention comprises a valve button having a terminal orifice established for communication with the valve stem and for opening the aerosol valve depression of the valve button. The valve button has a valve button recess for at least partially receiving a portion of the mounting cup turret when the valve button is in a depressed position. A filling aperture extends from an outer surface of the valve button to the valve button recess. A resilient sealing member is integrally disposed in the valve button recess for resiliently sealing with the mounting cup turret concurrently with the opening of the aerosol valve upon depression of the valve button enabling pressurization of the aerosol container through the filling aperture. In an alternative embodiment of the invention, the resilient sealing member is disposed integrally with and depending inwardly from the valve button.

12 Claims, 3 Drawing Sheets

AEROSOL ASSEMBLY FOR FILLING

This application is a continuation-in-part application of Ser. No. 347,886 filed Feb. 11, 1982, now abandoned, which is incorporated herein by reference.

BACKGROUND OF THE INVENTION

1. Field of the Invention

This invention relates to fluid sprinkling and spraying and more particularly to an improved aerosol assembly for filling the aerosol container through an aerosol button disposed on a valve stem.

2. Background of the Invention

Various types of apparati have been devised in the prior art to facilitate the charging of an aerosol container with a suitable propellant. Some in the prior art have attempted to fill aerosol containers through the upper sealing gasket disposed in the turret of a mounting cup. U.S. Pat. No. 3,838,799 to Meuresch et al discloses a rapid charging valve housing wherein the upper rim of the valve housing of an aerosol pressurized dispenser is given a generally castellated form to result in desirable deformation of the sealing gasket to provide auxiliary filling paths for charging the dispenser with propellant under pressure.

U.S. Pat. No. 3,319,669 to Abplanalp illustrates a device for filling an aerosol container through a button orifice disposed within the aerosol button. The aerosol button includes an annular sealing ring for sealing engagement with the mounting cup upon depression of the aerosol button enabling charging of propellant within the aerosol container through the button orifice disposed in the aerosol button.

Although the aforementioned U.S. Pat. No. 3,319,669 has satisfied some of the needs of the prior art, this apparatus has certain disadvantages which have been overcome by the present invention.

In the aforementioned apparatus, a non-resilient annular sealing ring is positioned in such a manner that the valve sealer does not contact a positive stop. Without the positive stop of the valve stem sealer, the valve button is inserted on the valve stem only against the urging of the valve body spring. In many cases, the valve button is not securely locked to the valve stem.

A further disadvantage of the aforementioned apparati resides in the substantial loss of propellant due to the relatively large diameter of the annular seal on the bottom surface of the aerosol button. In addition, the seal established between the annular seal on the valve button and the mounting cup turret is established only by a vertical pressure of a charging head. Since the annular ring is non-resilient, the tolerance of the position of the charging head is extremely critical during the pressurizing process.

Therefore it is an object of this invention to provide an apparatus which overcomes the aforementioned inadequacies of the prior art devices and provides an improvement which is a significant contribution to the aerosol art.

Another object of this invention is to provide an aerosol assembly and valve button for pressurized charging of the aerosol container through the valve button having a resilient sealing means integrally disposed in a valve button recess for resiliently sealing with a mounting cup turret concurrently with the opening of the aerosol valve upon depression of the valve button enabling pressurization of the aerosol container through a filling aperture extending through the valve button.

Another object of this invention is to provide an aerosol valve and valve button for pressurized charging of the aerosol container through the valve button wherein the valve button may be inserted on a valve stem when the valve sealer engages a positive stop disposed on the valve body.

Another object of this invention is to provide an aerosol assembly and valve button for pressurized charging of the aerosol container through the valve button wherein the resilient sealing means on the valve button provides a resilient sealing gasket for reducing the critical tolerances between the dimension of the valve stem and the dimension of a valve stem aperture within the valve button.

Another object of this invention is to provide an aerosol assembly and valve button for pressurized charging of the aerosol container wherein the resilient sealing means extends inwardly from a valve stem recess whereby the pressure of the propellant during charging enhances the seal of the resilient sealing means with the mounting cup turret of the aerosol valve assembly.

Another object of this invention is to provide an aerosol assembly and valve button for pressurized charging of the aerosol container through the valve button which is compatible for use with standard valve stem and mounting cups.

Another object of this invention is to provide an aerosol assembly and valve button for pressurized charging of the aerosol container through the valve button wherein the valve button has a valve button recess internal the resilient sealing means which is of a relatively low volume to reduce the loss of propellant during the charging process.

Another object of this invention is to provide an aerosol assembly and valve button wherein an annular resilient seal is disposed integrally with and depends inwardly from the valve button.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into an apparatus and method in an aerosol container comprising an aerosol valve and a mounting cup turret having a turret aperture for receiving a valve stem therethrough. The aerosol container receives an aerosol product therein for discharging through the valve stem upon opening the aerosol valve. The invention includes a valve button having a terminal orifice established for communication with the valve stem and for opening the aerosol valve upon depression of the valve button. The valve button includes a valve button recess for at least partially receiving a portion of the mounting cup turret therein when the valve button is in a depressed position. A filling aperture extends from an outer surface of the valve button to communicate with the valve button recess. A resilient sealing means is integrally disposed in the valve button recess for resiliently sealing with the mounting cup turret concurrently with the opening of the aerosol valve upon depression of the valve button enabling pressurization of the aerosol container through the filling aperture.

In a more specific embodiment of the invention, the resilient sealing means extends inwardly from the sidewalls of the valve button recess, preferably at an angular relationship whereby the pressure of the charging propellant facilitates the seal between the resilient sealing means and the mounting cup turret. The resilient sealing means is preferably tapered to provide a reduced thickness at the terminal end thereof for enabling a resilient sealing irrespective of the slight variations in tolerance of the valve stem and valve button.

In another embodiment of the invention, the aerosol button, valve stem and valve actuator are established such that the valve actuator engages a positive stop on the valve body upon depression of the valve stem enabling the valve button to be inserted and locked into position on the valve stem. In this position, the resilient sealing means is in sealing engagement with the mounting cup. Subsequently, the resilient sealing means forms a resilient seal with the mounting cup turret during pressurization of the aerosol container upon a second depression of the valve stem. The resilient sealing means is able to provide a proper seal with the mounting cup turret irrespective of whether the valve stem sealer is in engagement with the positive stop in the valve body. The resiliency of the sealing means reduces the need for controlling small tolerances within the valve body, the valve stem and the valve button as encountered by the prior art.

In a further embodiment of the invention, the resilient sealing means is disposed immediately adjacent the valve stem for reducing the volume of the passageway for pressurizing the aerosol container. The reduced volume of the pressurizing passageway substantially reduces the loss of propellant during the charging of the aerosol device. Preferably, the area outwardly of the resilient seal is void of plastic material by a core aperture thereby reducing the amount of plastic required for molding the improved button. In another embodiment of the invention, an annular sealing member is disposed integrally on and depends inwardly from the valve button.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 11 illustrates the fifth step in the method of inserting an aerosol button and filling an aerosol container wherein the aerosol container is filled through apertures within the valve button;

FIG. 12 illustrates the sixth step in the method of inserting an aerosol button and filling an aerosol container illustrating the completion of the filling process;

FIG. 13 is a side sectional view of a second embodiment of an aerosol button incorporating the present invention;

FIG. 14 is a side sectional view showing an alternate propellant flow path.

FIG. 15 is a side sectional view of a second embodiment of the present invention showing an annular sealing member depending inwardly from the valve button.

FIG. 16 is a sectional view taken on the line 16—16 of FIG. 15.

FIG. 17 is a top view of the second embodiment shown in FIG. 15;

FIG. 18 is a bottom view of the second embodiment shown in FIG. 15;

FIG. 19 is a side sectional view of the second embodiment shown secured to the valve stem; and FIG. 20 is a side sectional view of the second embodiment shown in the filling position.

Similar reference characters refer to similar parts throughout the several views of the drawing.

DETAILED DESCRIPTION

Figure 1:
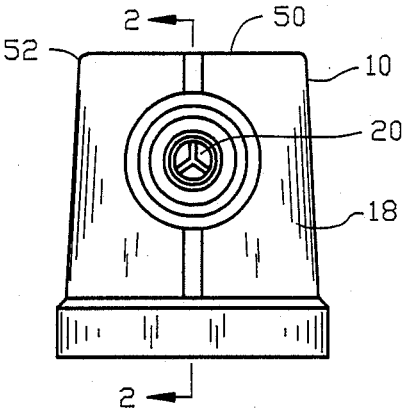
FIG. 1 is a front elevational view of an improved aerosol button incorporating the present invention.
Figure 2:
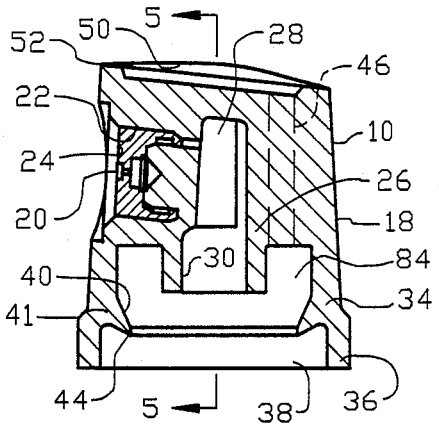
FIG. 2 is a sectional view along line 2—2 of FIG. 1.
Figure 3:
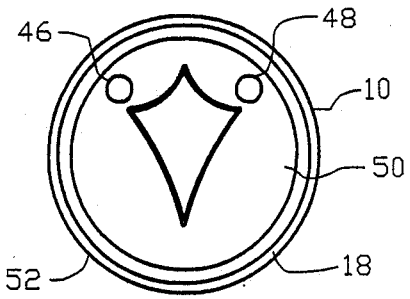
FIG. 3 is a top elevational view of the button shown in FIG. 1.
Figure 4:
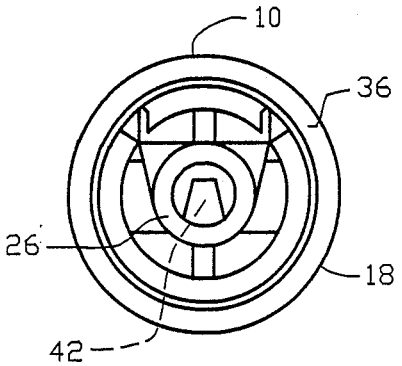
FIG. 4 is a bottom view of FIG. 1.
Figure 5:
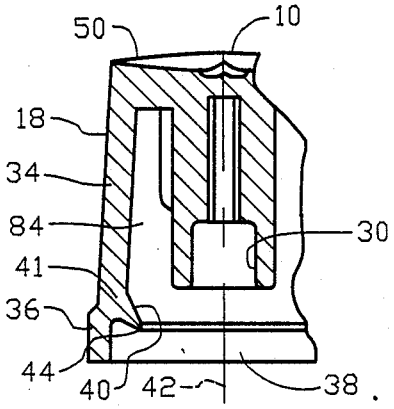
FIG. 5 is a sectional view along line 5—5 in FIG. 2.

FIGS. 1–6 illustrate the various views of a valve button 10 suitable for use with an aerosol valve assembly 12 shown in FIGS. 7–12, having a mounting cup 14 with a turret 16 to house an aerosol valve for a pressurized aerosol container. The valve button 10 includes a valve button body 18 having a terminal orifice 20, in this embodiment shown as a terminal orifice cavity 22 receiving a terminal orifice insert 24. Although the terminal orifice 20 has been disclosed as comprising a specific terminal orifice insert 24, it should be appreciated by those skilled in the art that various types of terminal orifice may be suitable for use with the present invention.

The terminal orifice 20 communicates with a boss 26 having an internal chamber 28 and a valve stem aperture 30 for receiving a valve stem 32 shown in FIGS. 7–12. The valve stem aperture 30 may optionally include an interlocking means (not shown) for securing the valve button 10 to the valve stem 32 as will be hereinafter described.

Figure 8:
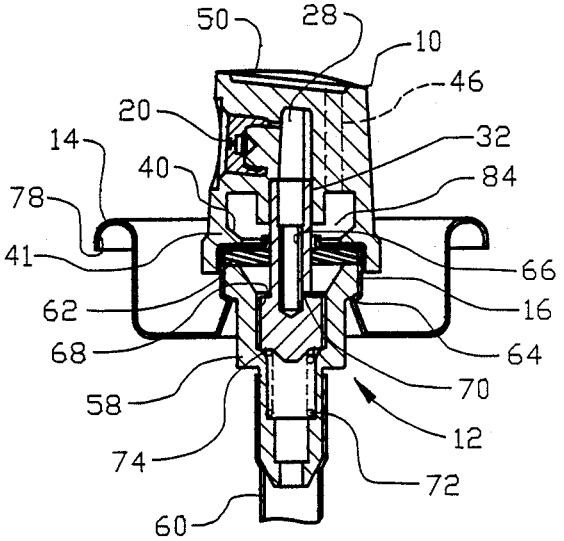
FIG. 8 is a second step in the method of inserting an aerosol button and filling an aerosol container showing the insertion of a valve button on a valve stem.

The valve button body 18 includes valve button sidewalls 34 and 36 defining a recess 38 selected to at least partially receive the mounting cup turret 16 as shown more fully in FIG. 8. A resilient sealing means 40 extends from a base 41 integral with the valve button sidewalls 34 and 36 in an angular relationship relative to an axis of symmetry 42 of the valve button 10. The resilient sealing means 40 is shown as an annular seal extending from the sidewalls 34 and 36 toward the recess 38. The resilient sealing means 40 includes a taper for providing a reduced thickness at the terminal end 44 of the annular seal. The reduced thickness of the resilient sealing means 40 provides a resiliency to the resilient sealing means which is an important aspect of the present invention.

Figure 6:
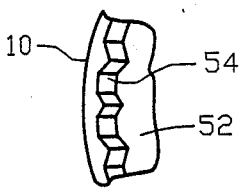
FIG. 6 is a part view of the top of the button shown in FIG. 1.

Filling means 46 and 48 extend from the top or outer surface 50 of the valve button 10 to communicate with the interior of the valve button and specifically with the recess 38. Although two filling apertures 46 and 48 have been shown in this embodiment, it should be apparent that a single or multiple filling apertures may be utilized with this invention. The upper periphery 52 of the valve button 10 is preferably castellated as shown by FIG. 6 to enable a positive grasp by a filling head as will be described in more detail hereinafter. The valve button shown in FIGS. 1–6 is preferably made of a unitary plastic material including the resilient means with a separate terminal orifice insert 24. However, the valve button, terminal insert and resilient sealing means may optionally be fabricated from a unitary plastic member.

Figure 9:
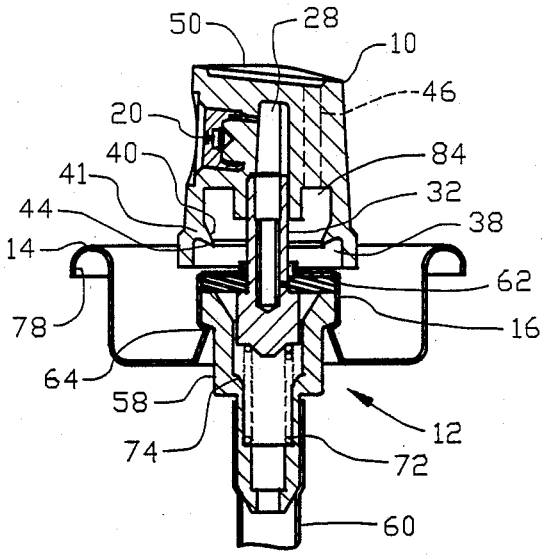
FIG. 9 is a third step in the method of inserting an aerosol button and filling an aerosol container wherein the aerosol button has returned to the unattended position.
Figure 10:
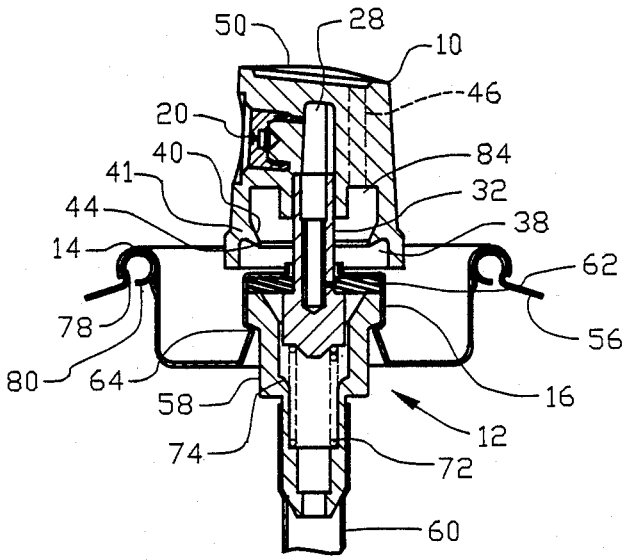
FIG. 10 illustrates the fourth step in the method of inserting an aerosol button and filling an aerosol container wherein the mounting cup has been sealed to the aerosol container.

FIGS. 7–12 illustrate the methods of inserting the valve button 10 on the valve stem 32 and filling an aerosol container 56 shown in FIGS. 10–12. The aerosol valve assembly 12 comprises a valve body 58 communicating with the interior of the aerosol container 56 through a dip tube 60. A sealing gasket 62 provides a seal between the mounting cup turret 16 and the upper periphery of the valve body 58 with a crimp 64 maintaining the sealing engagement. The valve stem 32 includes a stem orifice 66 and a valve stem sealer 68 with a metering orifice 70 communicating with the stem orifice 66. A spring 72 biases the valve stem sealer 68 into sealing engagement with the sealing gasket 62. Depression of the valve stem against the bias spring 72 causes a displacement of the metering orifice 70 from the sealing gasket 62 as shown more fully in FIG. 8 to open the valve as should be well known to those skilled in the art.

Figure 7:
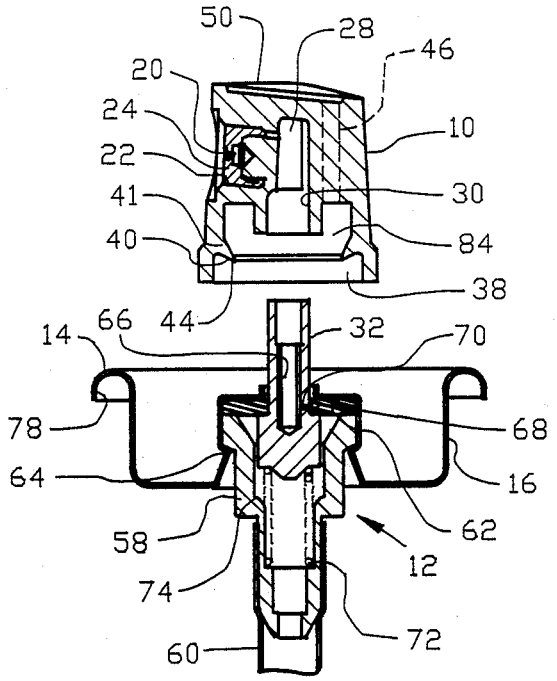
FIG. 7 is a first step in the method of inserting an aerosol button and filling the aerosol container.

FIG. 7 illustrates the first step in the method of inserting the aerosol button 10 and filling the aerosol container wherein the valve button 10 is located above the valve stem 32 by means (not shown). FIG. 8 illustrates the second step in the method of inserting an aerosol button and filling an aerosol container wherein the valve button 10 is inserted on the valve stem by an external force (not shown) and with the valve stem sealer 68 abutting a shoulder 74 of the valve body 58 to provide a positive stop to the movement of the valve stem 32. This positive stop insures that the valve stem 32 is completely received in the valve stem aperture 30 as shown in FIG. 8. The resilient sealing means 40 is appropriately deformed by the mounting cup turret 16 to enable the positive engagement to the button 10 onto the valve stem 32.

FIG. 9 illustrates the third step in the method of inserting an aerosol button and filling an aerosol container wherein the external force has been removed and bias spring 72 returns the valve stem 32 and valve button into an unattended position. It is conventional in the industry for the manufacturers of aerosol valve assemblies to fabricate the assembly as shown in FIG. 9 and thereafter ship the assemblies to a filling plant wherein the aerosol product is placed within the aerosol container 56 as shown and the peripheral lip 78 of the mounting cup 14 is sealed to a bead 80 of the aerosol container 56. FIG. 10 illustrates this fourth step wherein the mounting cup 14 has been secured to the aerosol container 56.

FIG. 11 illustrates the fifth step in the insertion of an aerosol button and filling an aerosol container wherein a filling head 82 displaces the aerosol valve button 10 to provide a fluid-tight seal between the valve button sidewalls 34 and 36 and the mounting cup turret 16 by the resilient sealing means 40. The resilient sealing means 40 is deformed by bending along the length thereof from the terminal end 44 to the base 41 to provide the fluid-tight seal enabling the aerosol propellant to pass through the filling apertures 46 and 48 thereby pressurizing the aerosol container 56. The sealing gasket 62 is deformed by virtue of the propellant passing through filling apertures 46 and 48 and a space generally designated 84 between the mounting cup turret 16 and the valve stem 32. Since the resilient sealing means 40 is bent or inclined toward the axis of symmetry 42 as set forth above, the pressure of the propllant forces the resilient sealing means 40 into contact with the turret 16 thereby enhancing the seal created therewith.

FIG. 12 illustrates the final assembled product after removal of the filling head 82 wherein the bias spring 72 returns the valve button 10 into the unattended position. It should be appreciated by those skilled in the art that by the use of the resilient sealing means 40 as set forth herein, precision tolerances of the valve stem and the valve stem aperture that was required by the prior art is eliminated. If the valve stem was too long or the valve stem aperture was too short, then a proper seal was not established with the rigid annular seal utilized by the prior art. Further, if the valve stem was too short or the valve stem aperture was too long, it was possible that the valve button would not be properly seated onto the valve stem since there was no positive stop to the movement of the valve stem as shown by the present invention in FIG. 8. The resilient sealing means 40 may be constructed of a very thin material since it is required to withstand deformation only one time prior to the sealing process shown in FIG. 11. Use of the resilient sealing means 40 as set forth herein will substantially benefit the aerosol art which pressurizes aerosol containers through button filling apertures.

FIG. 13 illustrates a variation of the invention shown in FIGS. 1–6. Similar parts are referred to with similar reference characters with the letter "A" incorporated therein. The button 10A includes a button body 18A having a terminal orifice 20A. Various types of terminal orifices may be used with the present invention. The terminal orifice commuicates with a boss 26A having an internal chamber 28A and a valve stem aperture 30A for receiving the valve stem 32 shown in FIGS. 7–12. The valve stem aperture 30A may optionally include an interlocking means (not shown) for securing the valve button 10A to the valve stem 32 as previously described. The valve button body 18A includes valve button sidewall 34A defining a recess 38A selected to at least partially receive the mounting cup turret 16 as shown with reference to FIG. 8. A resilient sealing means 40A extends from the boss 26A in an angular relationship relative to the axis of symmetry 42A of the valve button 10A. The resilient sealing means 40A is an annular seal extending from the boss 26A towards the recess 38A. In a similar manner to the embodiment of FIGS. 1–12, the resilient sealing means 40A includes a taper for providing a reduced thickness at the terminal end 44A of the annular seal relative to the base 41A. The reduced thickness of the resilient sealing means 40A provides a resiliency to the resilient sealing means enabling the resilient sealing means to bend which is an important aspect of the present invention. A filling aperture 46A interconnects the outer or top surface of the valve button to the recess 38A.

The embodiment shown in FIG. 13 operates in a manner similar to the embodiment shown in FIGS. 1–12. However this embodiment reduces the amount of propellant loss during the filling process. Since in the embodiment of FIG. 13 the resilient sealing means 40A is disposed on the centrally disposed boss 26A, the amount of propellant within the sealed volume of the button during the filling process is substantially reduced relative to the embodiment shown in FIGS. 1–12. Whereas propellant will occupy the volume 84 in FIG. 11 in the valve button 10, the volume in the embodiment shown in FIG. 13 is restricted to the volume 92 which substantially reduces propellant loss.

FIG. 14 is a side sectional view showing an alternate filling path for the invention described in FIGS. 1–13. In this embodiment, the valve button 10B includes a button body 18B having a terminal orifice 20B. Various types of terminal orifices may be used with this embodiment of the present invention. The terminal orifice 20B communicates with a boss 26B having an internal chamber 28B and a valve stem aperture 30B for receiving the valve stem 32 as shown in FIGS. 7–12. The valve stem aperture 30B may optionally include an interlocking means (not shown) for securing the valve button 10B to the valve stem 32 as previously described. The valve button body 18B includes sidewalls 34B and 36B defining a recess 38B selected to at least partially receive the mounting cup turret 16B as shown in FIG. 14. The resilient sealing means 40B extends from a base 41B of the valve button sidewalls 34B and 36B in an angular relationship relative to the axis of symmetry of the valve button 10B as shown more fully in FIG. 5. The resilient sealing means 40B is shown as an annular seal extending from the sidewalls 34B and 36B towards the recess 38B with a taper providing a reduced thickness at the terminal end 44B of the annular seal.

A filling aperture 46B extends from the top surface 50B of the valve button 10B to communicate with the interior of the valve button and specifically the recess 38B.

The aerosol valve button 10B cooperates with an aerosol valve assembly 12B comprising a valve body 58B communicating with the interior of an aerosol container 56B. A sealing gasket 62B provides a seal between the mounting cup turret 16B and the upper periphery of the valve body 58B by crimps 64B. The crimps 64B are intermittently disposed about the periphery of the turret 16B and the valve body 58B enabling a fluid flow path therebetween. The valve stem 32B includes a stem orifice 66B and a valve stem sealer 68B with a metering orifice 70B communicating with the stem orifice 66B. A spring 72B biases the valve stem sealer 68B into sealing engagement with the sealing gasket 62B. Depression of the valve stem against the bias spring 72B causes a displacement of the metering orifice 70B from the sealing gasket 62B as shown in FIG. 8 to open the valve as should be well known to those skilled in the art.

FIGS. 15–20 illustrate a variation of the invention shown in FIGS. 1–14. Similar parts are referred to with similar reference characters with the letter "C" incorporated therein. The button 10C includes a button body 18C having a terminal orifice 20C. Various types of terminal orifices may be used with the present invention. The terminal orifice communicates with a boss 26C having an internal chamber 28C and a valve stem aperature 30C for receiving the valve stem 32C shown in FIGS. 7–12. The valve stem aperture 30C may optionally include an interlocking means (not shown) for securing the valve button 10A to the valve stem 32C as previously described. The valve button body 18C includes valve button sidewall 34C defining a recess 38C selected to at least partially receive the mounting cup turret 16 as shown with reference to FIG. 8. A resilient sealing means 40C comprises a base 41C integral with a bottom surface 43C and extends in an angular relationship relative to the axis of symmetry 42C of the valve button 10C. In a similar manner to the embodiment of FIGS. 1–12, the resilient sealing means 40C includes a taper for providing a reduced thickness at the terminal end 44C of the annular seal relative to the base 41C. The reduced thickness of the resilient sealing means 40C provides a resiliency to the resilient sealing means enabling the resilient sealing means to bend which is an important aspect of the present invention. Filling apertures 46C and 48C interconnect the outer or top surface 50C of the valve button to the recess 38C.

The aerosol valve button 10C cooperates with an aerosol valve assembly 12C comprising a valve body 58C communicating with the interior of an aerosol container. A sealing gasket 62C provides a seal between the mounting cup turret 16C and the upper periphery of the valve body 58C by crimps 64C. The crimps 64C are intermittently disposed about the periphery of the turret 16C and the valve body 58C enabling a fluid flow path therebetween. The valve stem 32C includes a stem orifice 66C and a valve stem sealer 68C with a metering orifice 70C communicating with the stem orifice 66C. A spring 72C biases the valve stem sealer 68C into sealing engagement with the sealing gasket 62C. Depression of the valve stem against the bias spring 72C causes a displacement of the metering orifice 70C from the sealing gasket 62C as shown in FIG. 8 to open the valve as should be well known to those skilled in the art.

FIG. 20 illustrates the step of filling the aerosol container which is equivalent to the step shown in FIG. 14. However, it should be understood that the button 10C is not limited to the multiple paths filling and may be used in the method of filling set forth in FIGS. 1–12. In this embodiment, the resilient means 40C is bent about base 41C enabling the terminal end 44C to contact a lip 94C of the mounting cup turret 16C whereby fluid pressure provides a positive seal and enhances the seal between the resilient means 40C and the turret 16C. By virtue of the intermittently disposed crimps 64C the propellant flow path and charging includes multiple flow paths including a first flow path through the terminal orifice and the valve stem aperture 66C and through the metering orifice 70C. Concomitantly therewith, a second fluid flow path extends through the filling aperture 46C and 48C and between the lip 94C and valve stem 32C to deform the sealing gasket 62C. This embodiment illustrates the enhanced seal by the severe deformation or bending of the resilient means 40C as well as multiple flow paths as illustrated in FIG. 14 to enhance and provide a more rapid filling process to the aerosol container. It should be appreciated by those skilled in the art that the novelty set forth in FIG. 14 may be applied to the embodiments shown heretofore.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. In an aerosol container comprising an aerosol valve and a mounting cup turret having a turret aperture for receiving a valve stem therethrough, the aerosol container receiving an aerosol product and an aerosol propellant therein for discharge through the valve stem upon opening the aerosol valve, the improvement including a valve button for enabling the filling of the aerosol container with the aerosol propellant from a filling head while said valve button is disposed upon the valve stem, comprising in combination:

said valve button having a terminal orifice established for communication with the valve stem for spraying the aerosol product upon depression of said valve button;

said valve button including a filling aperture extending from an outer surface of said valve button to a button portion disposed adjacent the mounting cup turret;

resilient sealing means integrally extending from said valve button for resiliently sealing with the mounting cup turret concurrently with the opening of the aerosol valve upon a vertical depression of said valve button by the filling head enabling the filling of the aerosol container with the aerosol propellant through said filling aperture;

said resilient sealing means having a base portion adjacent said valve button and a terminal end with said resilient sealing means tapering from said base portion to said terminal end for providing a flexibility to said resilient sealing means along the length thereof to enable the pressure of the aerosol propellant during filling to enhance the seal of said resilient sealing means with said mounting cup turret of the aerosol valve; and said terminal end of said resilient sealing means engaging said mounting cup turret enabling said resilient sealing means to be bent inwardly towared the valve stem upon the vertical depression of said valve bottom by the filling head to create a seal between said resilient sealing means and the mounting cup turret irrespective of nominal variation in the dimensions of the aerosol device and irrespective of nominal variation in the vertical movement of the filling head.

2. A device as set forth in claim 1, wherein said resilient sealing means extends inwardly from a sidewall of said valve button recess.

3. A device as set forth in claim 1, wherein said resilient sealing means includes an annular seal extending from said valve button in an angular direction toward the central axis of symmetry of said valve button enabling the fluid pressure of the propellant during filling to enhance the seal between said valve button and the mounting cup turret.

4. A device as set forth in claim 3, wherein said valve button recess positions said valve button relative to the mounting cup turret upon engagement of said valve button recess with the sidewall of said mounting cup turret; and said annular seal being bent to resiliently seal with the top surface of the mounting cup turret upon depression of said valve button.

5. A device as set forth in claim 1, wherein the valve stem is integral with a position of the aerosol valve; and said valve button including a valve stem aperture for receiving the valve stem therebetween.

6. A device as set forth in claim 1, wherein the valve stem is integral with said valve button.

7. An appartus for charging an aerosol container with a propellant through a vertically movable filling head, comprising in combination:

a mounting cup comprising a mounting cup turret having a turret aperture;

a sealing gasket disposed in said mounting cup turret having a gasket aperture aligned with said turret aperture;

a valve body secured to said mounting cup in sealing engagement with said sealing gasket;

said valve body having a body cavity defined at least in part by a body shoulder with said body cavity being in fluid communication with the aerosol container;

a valve stem and sealer cooperating with said valve body with a valve stem extending through said gasket and turret apertures;

a valve button having a terminal orifice in fluid communication with said valve stem;

interlocking means disposed between said valve button and said valve stem for securing said valve button to said valve stem;

a filling aperture extending from an outer surface of said valve button to a valve button recess internal said valve button;

resilient sealing means integrally extending from said valve button for resiliently sealing with the mounting cup turret concurrently with the opening of the aerosol valve upon a vertical depression of said valve button by the filling head enabling the filling of the aerosol container with the aerosol propellant through said filling aperture;

said resilient sealing means having a base portion adjacent said valve button and a terminal end with said resilient sealing means tapering from said base portion to said terminal end for providing a flexibility to said resilient sealing means along the length thereof to enable the pressure of the aerosol propellant during filling to enhance the seal of said resilient sealing means with said mounting cup turret of the aerosol valve; and said terminal end of said resilient end of said resilient sealing means engaging said mounting cup turret enabling said resilient sealing means to be bent inwardly toward the valve stem upon the vertical depression of said valve bottom by the filling head to create a seal between said resilient sealing means and the mounting cup turret irrespective of nominal variation in the dimensions of the aerosol device and irrespective of nominal variation in the vertical movement of the filling head.

8. An apparatus as set forth in claim 7, wherein said resilient sealing means includes an annular seal extending from said valve button in an angular direction toward the central axis of symmetry of said valve button enabling the fluid pressure of the propellant during filling to enhance the seal between said valve button and said mounting cup.

9. An apparatus for charging an aerosol container with a propellant, comprising in combination:

a mounting cup comprising a mounting cup turret having a turret aperture;

a sealing gasket disposed in said mounting cup turret having a gasket aperture aligned with said turret aperture;

a valve body secured to said mounting cup in sealing engagement with said sealing gasket;

said valve body having a body cavity defined at least in part by a body shoulder with said body cavity being in fluid communication with the aerosol container;

a valve stem and sealer cooperating with said valve body with a valve stem extending through said gasket and turret apertures;

a valve button having a terminal orifice in fluid communication with said valve stem;

interlocking means disposed between said valve button and said valve stem for securing said valve button to said valve stem;

a filling aperture extending from an outer surface of said valve button to a valve button recess internal said valve button;

resilient sealing means integrally extending from said valve button for resiliently sealing with the mounting cup turret concurrently with the opening of the aerosol valve upon a vertical depression of said valve button by the filling head enabling the filling of the aerosol container with the aerosol propellant through said filling aperture;

said resilient sealing means having a base portion adjacent said valve button and a terminal end with said resilient sealing means tapering from said base portion to said terminal end for providing a flexibility to said resilient sealing means along the length thereof to enable the pressure of the aerosol propellant during filling to enhance the seal of said resilient sealing means with said mounting cup turret of the aerosol valve; and said terminal end of said resilient end of said resilient sealing means engaging said mounting cup turret enabling said resilient sealing means to be bent inwardly toward the valve stem upon the vertical depression of said valve bottom by the filling head to create a seal between said resilient sealing means and the mounting cup turret irrespective of nominal variation in the dimensions of the aerosol device and irrespective of nominal variation in the vertical movement of the filling head.

10. An apparatus as set forth in claim 9, wherein said resilient sealing means includes an annular seal extending from said valve button in an angular direction toward the central axis of symmetry of said valve button enabling the fluid pressure of the propellant during filling to enhance the seal between said valve button and said mounting cup.

11. In an aerosol container comprising an aerosol valve and a mounting cup turret having a turret aperture for receiving a valve stem therethrough, the aerosol container receiving an aerosol product therein for discharge through the valve stem upon opening the aerosol valve, the improvement comprising:

a valve button having a terminal orifice established for communication with the valve stem for spraying the aerosol product upon depression of the valve button;

said valve button including a filling aperture extending from an outer surface of said valve button to a button portion disposed adjacent the mounting cup turret; and resilient sealing means integrally depending inwardly from said button portion for resiliently sealing with the mounting cup turret concurrently with the opening of the aerosol valve upon depression of said valve button enabling pressurization of the aerosol container through the filling aperture and for enhancing the seal of said resilient sealing means with said mounting cup turret during pressurization of the aerosol container.

12. A device as set forth in claim 11, wherein said resilient sealing means includes an annular seal having a taper providing a reduced thickness at the terminal end of resilient sealing means.

* * * * *

UNITED STATES PATENT AND TRADEMARK OFFICE

CERTIFICATE OF CORRECTION

PATENT NO. : 4,915,266

DATED : April 10, 1990

INVENTOR(S) : Knickerbocker

It is certified that error appears in the above-identified patent and that said Letters Patent is hereby corrected as shown below:

Title Page,
in the Abstract

Line 9, after "valve" insert --upon--.

In the Claims

Claim 5, column 10, line 22, delete "position" and insert therefore --portion--.

Claim 12, column 12, line 50, after "of" insert --said--.

Signed and Sealed this

Sixth Day of August, 1991

*Attest:*

HARRY F. MANBECK, JR.

*Attesting Officer*

*Commissioner of Patents and Trademarks*